US006776683B1

(12) United States Patent
Lin

(10) Patent No.: US 6,776,683 B1
(45) Date of Patent: Aug. 17, 2004

(54) EYE CONSTRUCTION FOR A TOY DOLL

(76) Inventor: Hong-Tien Lin, No. 184, Hua-Kang St., Pa-Te City, Taoyuan Hsien (TW)

( * ) Notice: Subject to any disclaimer, the term of this patent is extended or adjusted under 35 U.S.C. 154(b) by 0 days.

(21) Appl. No.: 10/717,471

(22) Filed: Nov. 21, 2003

(51) Int. Cl.[7] ..... A63H 3/38
(52) U.S. Cl. ..... 446/392; 446/342; 446/343
(58) Field of Search ..... 446/392, 393, 446/389, 301, 341, 342, 343, 344, 345, 346, 348, 349, 350

(56) References Cited

U.S. PATENT DOCUMENTS 3,383,793 A * 5/1968 Bonanno ..... 446/130
3,492,760 A * 2/1970 Nishitani ..... 446/130
3,616,572 A * 11/1971 Kosicki et al. ..... 446/346
3,660,932 A * 5/1972 Raffeli et al. ..... 446/346
5,281,183 A * 1/1994 Bernhardt et al. ..... 446/345
5,769,687 A * 6/1998 Ko ..... 446/343
6,220,923 B1 * 4/2001 Lin ..... 446/392
2002/0049023 A1 * 4/2002 Simeray ..... 446/392

* cited by examiner

*Primary Examiner*—Derris H. Banks
*Assistant Examiner*—Ali Abdelwahed
(74) *Attorney, Agent, or Firm*—Rosenberg, Klein & Lee

(57) ABSTRACT

An eye for a toy doll is formed by a housing inside which an eyelid body and an eyeball body are pivotally retained, wherein the eyelid body and the eyeball body are respectively controlled by two moving control plates. Each moving plate has two pushing rods movably mounted thereon via memory alloy wires. When a current is applied on the memory alloy wires, the length of the memory alloy wire is reduced thus driving the pushing rods to press against the eyelid body and the eyeball body to generate blinking and rotating movements.

19 Claims, 5 Drawing Sheets

EYE CONSTRUCTION FOR A TOY DOLL

BACKGROUND OF THE INVENTION

1. Field of the Invention

The present invention relates to an eye construction for a toy doll, and more particularly to a doll eye capable of generating slight movements of eyeballs and eyelids by electrifying memory alloy wires adopted in the eye construction.

2. Description of Related Art

To create novel, interesting and funny products that can catch the attention of consumers is a key aim for a toy designer. It is noted that the beautiful appearance was a dominant factor in earlier times, however interaction functions in toy products have become the most required feature nowadays.

For example, dynamic functions such as to swing limbs of the doll or to play music have become integrated in the present toys. In general, it is much easier to accomplish and control a larger movement on a doll than tiny actions. However, slight movement may be necessary to express some exquisite actions such as the eyeball rotation.

For the toy eyes, it is desired to control the eyeballs and eyelids, such as being able to generate rotating and blinking. A particularly well known way for controlling the eyes is that the eyelids can be gradually closed while the doll is lying down, and vice versa. However, the foregoing movements are still not good enough to replicate the real action.

SUMMARY OF THE INVENTION

The main objective of the present invention is to provide an eye construction that can generate exquisite movements such as the eyeball rotation and eyelid blinking by the use of memory alloy wires.

Other objects, advantages and novel features of the invention will become more apparent from the following detailed description when taken in conjunction with the accompanying drawings.

DETAILED DESCRIPTION OF THE PREFERRED EMBODIMENT

Figure 1:
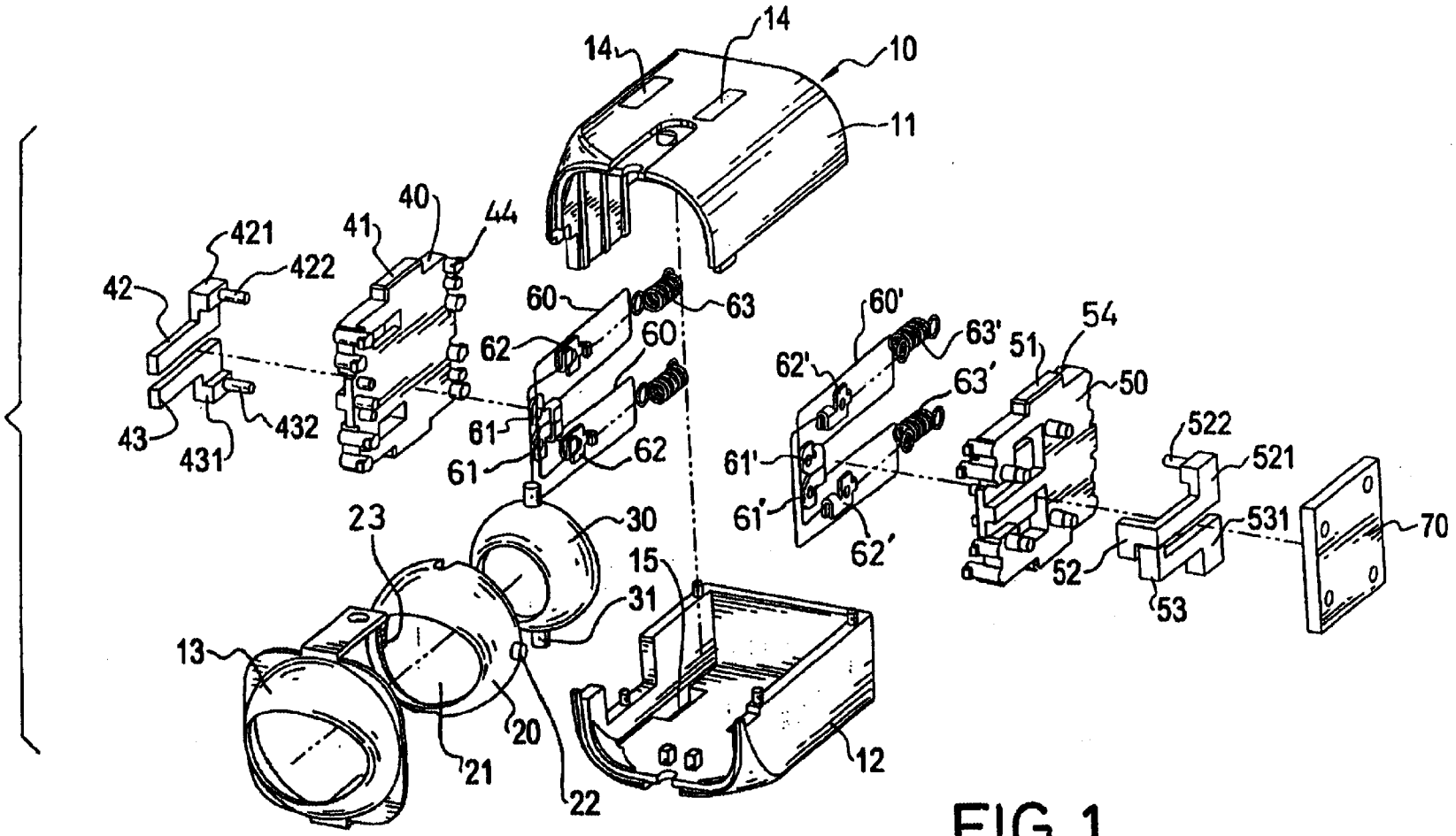
FIG. 1 is an exploded perspective view of an eye construction for a toy doll in accordance with the present invention.
Figure 2:
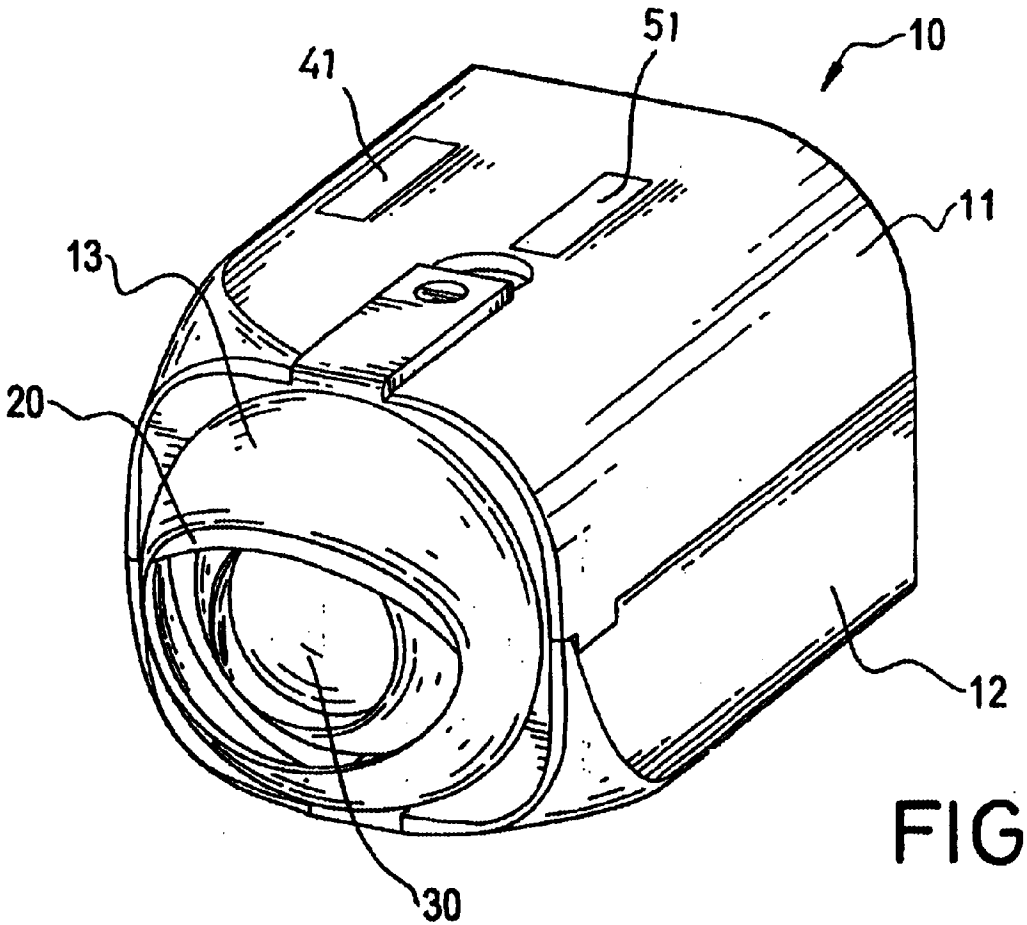
FIG. 2 is a perspective view of the eye construction for a toy doll in accordance with the present invention.

With reference to FIGS. 1 and 2, an eye construction of the present invention is composed of a hollow housing (10), an eyelid body (20), an eyeball body (30), an eyelid moving control plate (40), an eyeball moving control plate (50), a plurality of memory alloy wires (60) and a control circuit board (70).

The housing (10) comprises an upper-case (11) and a lower case (12) that correspondingly combine together, where a mouth (not numbered) is thus defined at one side of the housing (10). The upper and lower cases (11)(12) are both defined with several apertures (14)(15). A frame body (13) has a hemispherical shell in which a hole is defined, wherein the frame body (13) is attached at front of said mouth of the housing (10).

Figure 4:
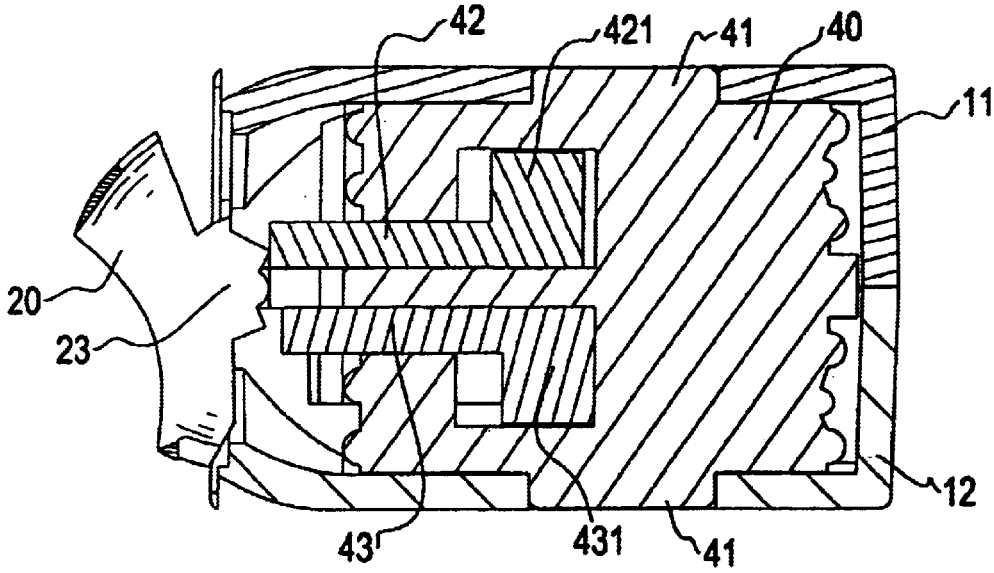
FIG. 4 is a schematic cross-section view showing the movement of the eyelid of the present invention.
Figure 5:
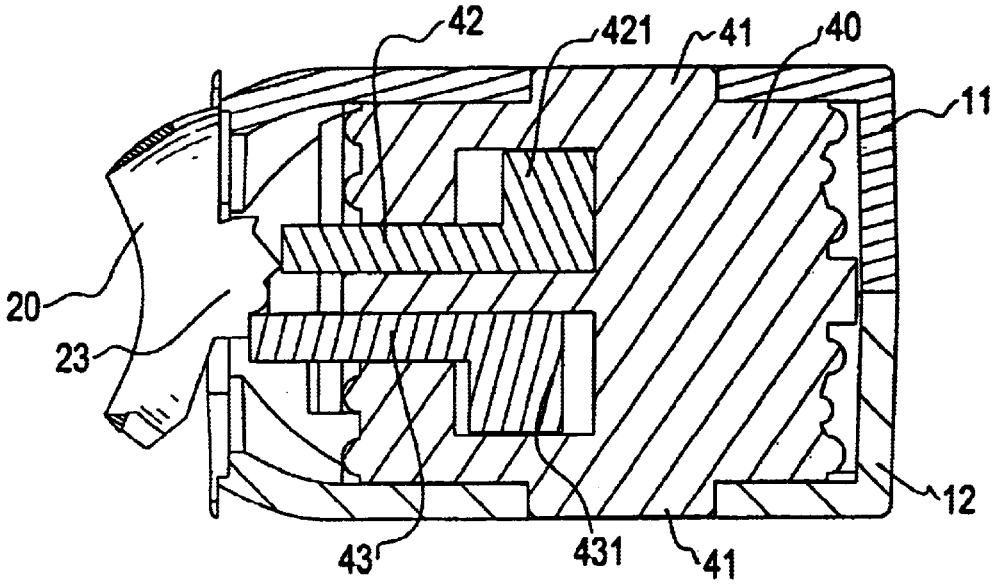
FIG. 5 is another schematic cross-section view showing the movement of the eyelid of the present invention.

The eyelid body (20) is formed by a hemispherical shell on which an opening (21) is defined, where the upper portion of the eyelid body (20) as the upper eyelid is wider than the lower portion. A pair of first stubs (22) protrude from an outer surface of the right and left sides of the eyelid body (20), with which the eyelid body (20) is pivotally attached inside the housing (10) and behind the frame body (13). With reference to FIGS. 4 and 5, a lengthwise block (23) integrally extends from an edge of the eyelid body (20) and near the stub (22).

Figure 6:
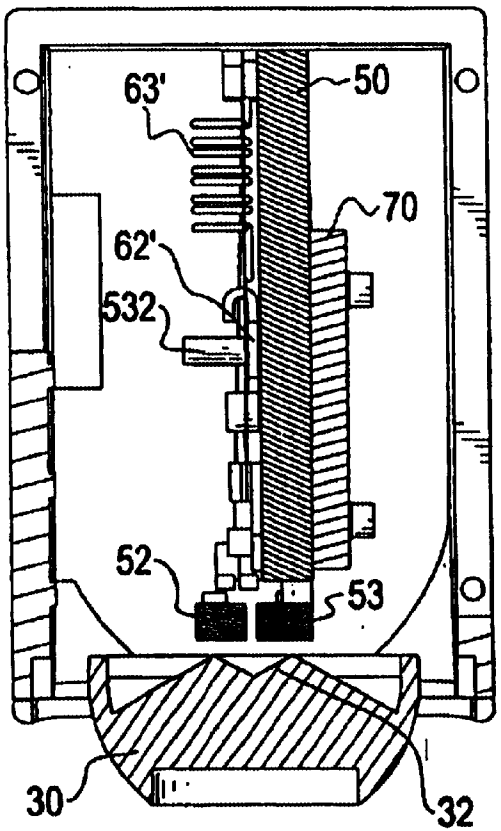
FIG. 6 is a cross-section view showing the movement of the eyeball of the present invention.

The eyeball body (30) is formed as a hemispherical ball, where a front arcuate surface of the hemispherical ball is used for forming the pupil pattern. Two second stubs (31) are respectively formed at the top and bottom sides of the outer surface of the eyeball body (30). The eyeball body (30) is pivotally attached inside the housing (10) via the second stubs (31) and behind said eyelid body (20). As shown in FIG. 6, a lateral block (32) is formed at a center of the inner surface of the eyeball body (30).

The eyelid moving control plate (40) has two buckling protrusions (41) formed at an upper edge and a lower edge of the plate (40) to correspondingly insert through the apertures (14)(15) of the upper and lower cases (11)(12). An outer surface of the eyelid moving control plate (40) is defined with two concavities (not shown in the drawings) each of which is communicated with a rectangular hole (not numbered) defined through the plate (40). A first pushing rod (42) and a second pushing rod (43) are retained in the concavities of the eyelid moving control plate (40). One distal end of each pushing rod (42)(43) is formed as a stepping block (421)(431) from which a column (422)(432) extends. When the two stepping blocks (42)(43) are retained in the concavities, the two columns (422)(432) protrude through the two rectangular holes. Several wire protrusions (44) are formed on an inner surface of the eyelid moving control plate (40) so that two memory alloy wires (60) can twist around the wire protrusions (44). Each memory alloy wire (60) has two ends that respectively connect to a first conductive member (61) and a second conductive member (62). Each first conductive member (61) is securely mounted on the inner surface of the eyelid moving control plate (40). Each second conductive member (62) is further buckled to a spring (63) and is moveable relative to the eyelid moving control plate (40). It is noted that the two columns (422)(432) on the stepping block (421)(431) are individually connected to a respective second conductive members (62).

The arrangement of the eyeball moving control plate (50) is substantially the same as the aforementioned eyelid moving control plate (40). The eyeball moving control plate (50) also has two buckling protrusions (51) for correspondingly inserting through the apertures (14)(15). Third and fourth pushing rods (52)(53), each having a stepping block (521)(531) and a column (522)(only one column is shown on the drawing) are attached to an outer surface of the eyeball moving control plate (50), wherein the control circuit board (70) is further placed beside the two pushing rods (52)(53). Two memory alloy wires (60') are twisted on wire protrusions (54) formed on an inner surface of the eyeball moving control plate (50) like the arrangement of said two alloy wires (60).

The control circuit board (70) is electrically connected to each spring (63)(63') and each first conductive member (61)(61') to determine which memory alloy wire (60)(60') should be provided with a current.

The preferable material for the memory alloy wires (60)(60') is nickel-titanium alloy. The physical characteristic of such an alloy wire is that the molecule arrangement density will be varied with the temperature and thus occurring a deformation on the shape. That is, with the increasing of the temperature, the alloy wire will be lengthened, and once the temperature is lowered, the alloy wire returns to its original length. Based on the physical characteristic, if a current is applied on the memory alloy wires (60)(60'), the heat caused from the current will result in the increase of the wire length. Otherwise, once the current is cut off, the memory alloy wires (60)(60') will resume the original status.

Figure 3:
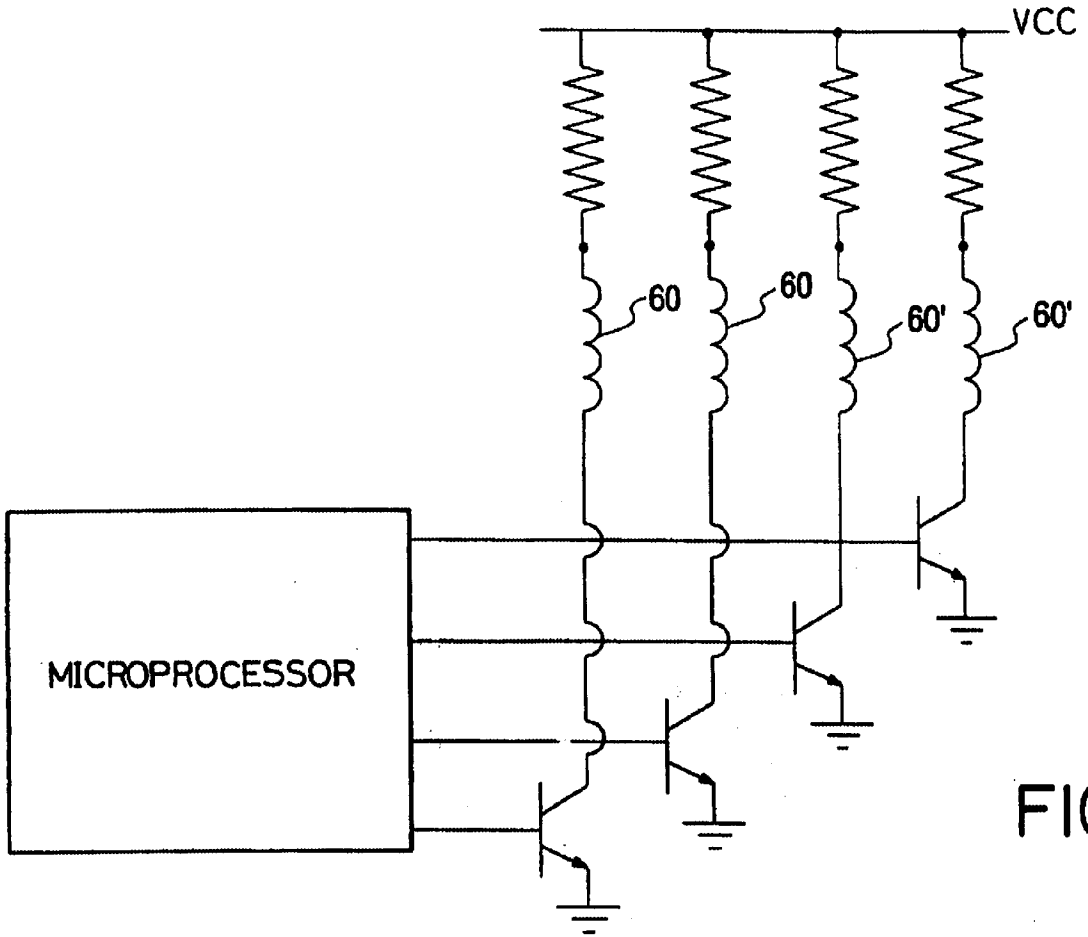
FIG. 3 is a control circuit diagram of the present invention.

With reference to FIG. 3, a microprocessor controls the activation of four transistors used as the switching elements. The foregoing four memory alloy wires (60)(60') are respectively connected to the four switching elements in series, where a current limiting resistor is connected between the operating voltage (Vcc) and one memory alloy wire (60)(60') as an over-current protection element. With the activation of the switching element, a current from the operating voltage (Vcc) flows through the current limiting resistor, the memory alloy wire (60)(60') and the activated switching element to ground.

With reference to FIG. 4, the viewing direction of the cross-section plan is from the outer surface of the eyelid control moving board (40) and some elements such as the eyeball body (30) are omitted from the drawing for the sake of clarity. When a current flows through the memory alloy wire (60) that links to the first pushing rod (42) via the second conductive member (62), the length of the memory alloy wire (60) is reduced. Because one end of the memory alloy wire (60) is connected to a fixed first conductive member (61), and the other end is connected to a movable second conductive member (62), the second conductive member (62) is moved forward and thus drives the first pushing rod (42) to thrust against an upper edge of the lengthwise block (23) of the eyelid body (20) while the alloy wire (60) is contracted. Therefore, the eyelid body (20) will slightly move downward to imitate the blinking action.

On the contrary, with reference to FIG. 5, when the lower edge of the lengthwise block (23) is pushed by the second pushing rod (43), the eyelid body (20) is opened.

Figure 8:
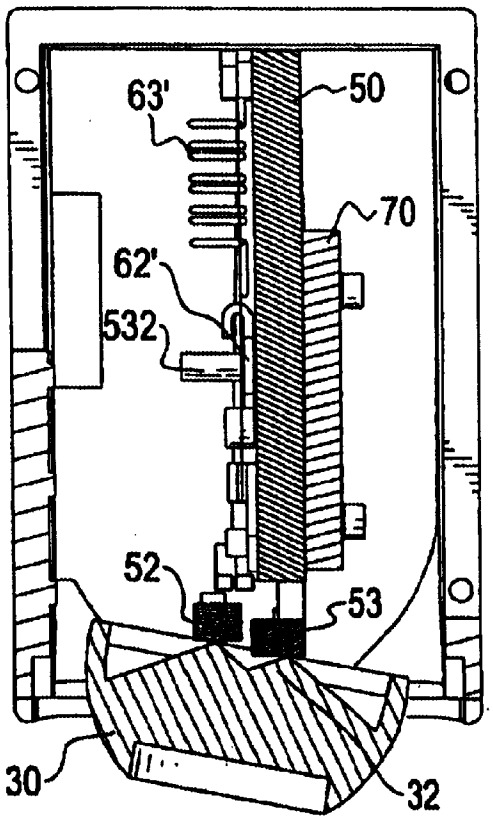
FIG. 8 is still another cross-section view showing the movement of the eyeball of the present invention.
Figure 7:
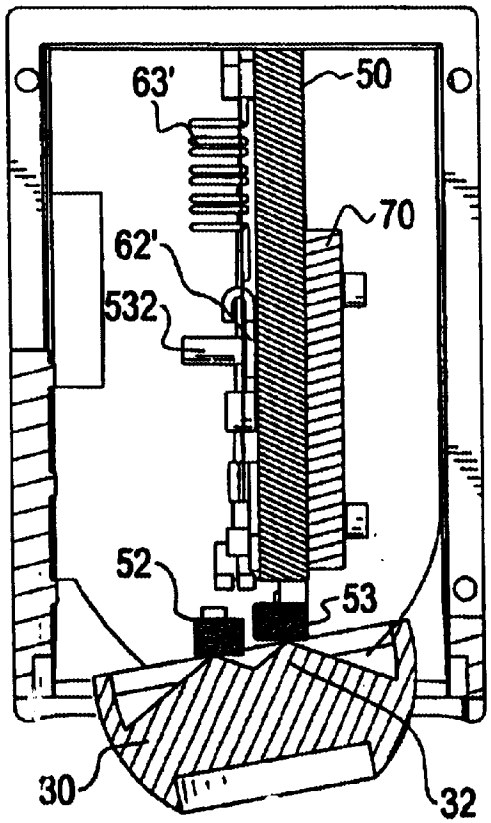
FIG. 7 is another cross-section view showing the movement of the eyeball of the present invention.

With reference to FIG. 6, where there is no current applied to the memory alloy wires (60') mounted on the eyeball moving control plate (50), the third and fourth pushing rods (52)(53) have no movements so the eyeball body (30) is faced forward. As shown in FIG. 7, while the third pushing rod (52) is moved forward to press against a left side of the lateral block (32), the eyeball body (30) turns to the right side. Similarly, as shown in FIG. 8, while the fourth pushing rod (53) presses against a right side of the lateral block (32), the eyeball body (30) turns to left.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the fill extent indicated by the broad general meaning of the terms in which the appended claims are expressed.

What is claimed is:

1. An eye construction for a toy doll, the eye construction comprising:

a housing (10) with a mouth to which a hollow frame (13) is attached;

an eyelid body (20) pivotally arranged inside the housing (10) and behind the hollow frame (13);

an eyeball body (30) pivotally arranged inside the housing (10) and behind the eyelid body (20);

an eyelid moving control plate (40) securely mounted inside the housing (10), wherein a first pushing rod (42) and a second pushing rod (43) are movably attached on the eyelid moving control plate (40) via two memory alloy wires (60), wherein the first and the second pushing rods (42)(43) alternately push the eyelid body (20) thus allowing the eyelid body (20) to generate a blinking action;

an eyeball moving control plate (50) securely mounted inside the housing (10), wherein a third pushing rod (52) and a fourth pushing rod (53) are movably attached on the eyeball moving control plate (50) via two memory alloy wires (60'), wherein the third and the fourth pushing rods (52)(53) alternately push the eyeball body (30) thus allowing the eyeball body (30) to generate a rotation; and a control circuit board (70) arranged inside the housing (10) and electrically connected to the memory alloy wires (60)(60') on the eyelid moving control plate (40) and eyeball moving control plate (50), wherein the control circuit board (70) provides a current to the memory alloy wires (60)(60').

2. The eye construction as claimed in claim 1, wherein the housing is formed by an upper case (11) and a lower case (12) both correspondingly combined together, where the mouth is thus defined at one side of the housing (10), wherein the frame (13) has a hemispherical shell on which a through hole is defined.

3. The eye construction as claimed in claim 1, wherein the eyelid body (20) is formed by a hemispherical shell on which an opening (21) is defined, where an upper portion above the opening (21) is wider than a lower portion of the eyelid body (20);

a pair of first stubs (22) extending from an outer surface of opposite sides of the eyelid body (20), wherein the eyelid body (20) is pivotally attached inside the housing (10) via the two first stubs (22); and a lengthwise block (23) extending from an edge of the eyelid body (20) near one of the two stubs (22).

4. The eye construction as claimed in claim 1, wherein the eyeball body (30) is formed by a hemispherical ball, and a front arcuate surface of the hemispherical ball is used for forming a pupil pattern;

two second stubs (31) respectively formed at a top side and a bottom side of an outer surface of the eyeball body (30), whereby the eyeball body (30) is pivotally attached inside the housing (10) via the two second stubs (31); and a lateral block (32) formed at a center of an inner surface of the eyeball body (30).

5. The eye construction as claimed in claim 3, wherein the eyeball body (30) is formed by a hemispherical ball, and a front arcuate surface of the hemispherical ball is used for forming a pupil pattern;

two second stubs (31) respectively formed at a top side and a bottom side of an outer surface of the eyeball body (30), whereby the eyeball body (30) is pivotally attached inside the housing (10) via the two second stubs (31); and a lateral block (32) formed at a center of an inner surface of the eyeball body (30).

6. The eye construction as claimed in claim 2, wherein the eyelid moving control plate (40) and the eyeball moving control plate (50) both have two buckling protrusions (41) (51) formed at an upper edge and a lower edge of the eyelid moving control plate (40) and the eyeball moving control plate (50) to correspondingly insert through apertures (14) (15) defined in the upper and lower cases (11)(12).

7. The eye construction as claimed in claim 2, wherein the eyelid moving control plate (40) and the eyeball moving control plate (50) both have two buckling protrusions (41) (51) formed at an upper edge and a lower edge of the eyelid moving control plate (40) and the eyeball moving control plate (50) to correspondingly insert through apertures (14) (15) defined on the upper and lower cases (11)(12).

8. The eye construction as claimed in claim 6, wherein the eyelid moving control plate (40) has an outer surface in which two concavities are defined to respectively retain the first pushing rod (42) and the second pushing rod (43), and each concavity is communicated with a hole defined through the eyelid moving control plate (40);

wherein one distal end of each of the first and the second pushing rods (42)(43) is formed as a stepping block (421)(431) from which a column (422)(432) extends, after the first and the second pushing rods (42)(43) are retained in said concavities, the two columns (422) (432) respectively protrude through the two holes.

9. The eye construction as claimed in claim 7, wherein the eyelid moving control plate (40) has an outer surface in which two concavities are defined to respectively retain the first pushing rod (42) and the second pushing rod (43), and each concavity is communicated with a hole defined through the eyelid moving control plate (40);

wherein one distal end of each of the first and the second pushing rods (42)(43) is formed as a stepping block (421)(431) from which a column (422)(432) extends, after the first and the second pushing rods (42)(43) are respectively retained in said concavities, the two columns (422)(432) protrude through the two holes.

10. The eye construction as claimed in claim 8, wherein multiple wire protrusions (44) are formed on an inner surface of the eyelid moving control plate (40) so that the two memory alloy wires (60) are securable to the wire protrusions (44);

wherein each memory alloy wire (60) has two ends that respectively connect to a first conductive member (61) and a second conductive member (62), wherein each first conductive member (61) is securely mounted on the inner surface of the eyelid moving control plate (40) and each second conductive member (62) is moveable relative to the eyelid moving control plate (40) and further buckles to a spring (63);

the two columns (422)(432) on the stepping block (421) (431) individually linked to a respective one of the second conductive members (62).

11. The eye construction as claimed in claim 9, wherein multiple wire protrusions (44) are formed on an inner surface of the eyelid moving control plate (40) so that the two memory alloy wires (60) are securable to the wire protrusions (44);

wherein each memory alloy wire (60) has two ends that respectively connect to a first conductive member (61) and a second conductive member (62), wherein each first conductive member (61) is securely mounted on the inner surface of the eyelid moving control plate (40) and each second conductive member (62) is moveable relative to the eyelid moving control plate (40) and further buckles to a spring (63);

the two columns (422)(432) on the stepping block (421) (431) individually linked to a respective one of the second conductive members (62).

12. The eye construction as claimed in claim 6, wherein the eyeball moving control plate (50) has an outer surface on which two concavities are defined to retain the third pushing rod (52) and the fourth pushing rod (53), and each concavity is communicated with a respective hole defined through the eyeball moving control plate (50);

wherein one distal end of each of the third and the fourth pushing rods (52)(53) is formed as a stepping block (521)(531) from which a column (522) extends, after the third and the fourth pushing rods (52)(53) are retained in said concavities, whereby the two columns (522) respectively protrude through the two holes.

13. The eye construction as claimed in claim 7, wherein the eyeball moving control plate (50) has an outer surface on which two concavities are defined to respectively retain the third pushing rod (52) and the fourth pushing rod (53), and each concavity is communicated with a hole defined through the eyeball moving control plate (50);

wherein one distal end of each of the third and the fourth pushing rods (52)(53) is formed as a stepping block (521)(531) from which a column (522) extends, after the third and the fourth pushing rods (52)(53) are respectively retained in said concavities, whereby the two columns (522) respectively protrude through the two holes.

14. The eye construction as claimed in claim 10, wherein the eyeball moving control plate (50) has an outer surface in which two concavities are defined to retain the third pushing rod (52) and the fourth pushing rod (53), and each concavity is communicated with a respective hole defined through the eyeball moving control plate (50);

wherein one distal end of each of the third and the fourth pushing rods (52)(53) is formed as a stepping block (521)(531) from which a column (522) extends, after the third and the fourth pushing rods (52)(53) are respectively retained in said concavities, whereby the two columns (522) respectively protrude through the two holes.

15. The eye construction as claimed in claim 11, wherein the eyeball moving control plate (50) has an outer surface on which two concavities are defined to retain the third pushing rod (52) and the fourth pushing rod (53), and each concavity is communicated with a respective hole defined through the eyeball moving control plate (50);

wherein one distal end of each of the third and the fourth pushing rods (52)(53) is formed as a stepping block (521)(531) from which a column (522) extends, after the third and the fourth pushing rods (52)(53) are respectively retained in said concavities, the two columns (522) respectively protrude through the two holes.

16. The eye construction as claimed in claim 12, wherein multiple wire protrusions (54) are formed on an inner surface of the eyeball moving control plate (50) so that the two memory alloy wires (60') are twisted around the wire protrusions (54);

wherein each memory alloy wire (60') has two ends that respectively connect to a first conductive member (61') and a second conductive member (62'), wherein each first conductive member (61') is securely mounted on the inner surface of the eyeball moving control plate (50) and each second conductive member (62') is moveable relative to the eyeball moving control plate (50) and further buckles to a spring (63');

wherein the two columns (522) on the stepping block (521)(531) of the third and the fourth pushing rods (52)(53) are individually linked to a respective one of the second conductive members (62').

17. The eye construction as claimed in claim 13, wherein multiple wire protrusions (54) are formed on an inner surface of the eyeball moving control plate (50) so that the two memory alloy wires (60') are twisted around the wire protrusions (54);

wherein each memory alloy wire (60') has two ends that respectively connect to a first conductive member (61') and a second conductive member (62'), wherein each first conductive member (61') is securely mounted on the inner surface of the eyeball moving control plate (50) and each second conductive member (62') is moveable relative to the eyeball moving control plate (50) and further buckles to a spring (63');

wherein the two columns (522) on the stepping block (521)(531) of the third and the fourth pushing rods (52)(53) are individually linked to a respective one of the second conductive members (62').

18. The eye construction as claimed in claim 14, wherein multiple wire protrusions (54) are formed on an inner surface of the eyeball moving control plate (50) so that the two memory alloy wires (60') are twisted around the wire protrusions (54);

wherein each memory alloy wire (60') has two ends that respectively connect to a first conductive member (61') and a second conductive member (62'), wherein each first conductive member (61') is securely mounted on the inner surface of the eyeball moving control plate (50) and each second conductive member (62') is moveable relative to the eyeball moving control plate (50) and further buckles to a spring (63');

wherein the two columns (522) on the stepping block (521)(531) of the third and the fourth pushing rods (52)(53) are individually linked to a respective one of the second conductive members (62').

19. The eye construction as claimed in claim 15, wherein multiple wire protrusions (54) are formed on an inner surface of the eyeball moving control plate (50) so that the two memory alloy wires (60') are twisted around the wire protrusions (54);

wherein each memory alloy wire (60') has two ends that respectively connect to a first conductive member (61') and a second conductive member (62'), wherein each first conductive member (61') is securely mounted on the inner surface of the eyeball moving control plate (50) and each second conductive member (62') is moveable relative to the eyeball moving control plate (50) and further buckles to a spring (63');

wherein the two columns (522) on the stepping block (521)(531) of the third and the fourth pushing rods (52)(53) are individually linked to a respective one of the second conductive members (62').

* * * * *